US007143813B2

(12) United States Patent
Delgado, Jr. et al.

(10) Patent No.: US 7,143,813 B2
(45) Date of Patent: Dec. 5, 2006

(54) FOAM BUMPER AND RADIATOR FOR A LIGHTWEIGHT HEAT REJECTION SYSTEM

(75) Inventors: Adon Delgado, Jr., West Hills, CA (US); Michael P. Moriarty, Simi Valley, CA (US); Alan von Arx, Northridge, CA (US)

(73) Assignee: The Boeing Company, Chicago, IL (US)

( * ) Notice: Subject to any disclaimer, the term of this patent is extended or adjusted under 35 U.S.C. 154(b) by 16 days.

(21) Appl. No.: 10/901,837

(22) Filed: Jul. 28, 2004

(65) Prior Publication Data

US 2006/0021738 A1 Feb. 2, 2006

(51) Int. Cl.
*B60H 1/00* (2006.01)

(52) U.S. Cl. ..... 165/41; 165/104.21; 244/57; 244/171.8

(58) Field of Classification Search ..... 165/41, 165/104.26, 104.21; 244/163, 158 R, 41, 244/57, 171.8
See application file for complete search history.

(56) References Cited

U.S. PATENT DOCUMENTS 4,420,035 A * 12/1983 Hewitt ..... 165/273
4,738,304 A * 4/1988 Chalmers et al. ..... 165/281
4,832,113 A * 5/1989 Mims et al. ..... 165/41
4,838,346 A * 6/1989 Camarda et al. ..... 165/104.14
4,852,645 A * 8/1989 Coulon et al. ..... 165/180
5,027,892 A * 7/1991 Bannon et al. ..... 165/41
5,036,905 A * 8/1991 Eninger et al. ..... 165/41
5,042,565 A * 8/1991 Yuen et al. ..... 165/41
5,069,274 A * 12/1991 Haslett et al. ..... 165/272
5,077,103 A * 12/1991 Wagner et al. ..... 428/34.1
5,640,853 A * 6/1997 Baker et al. ..... 62/48.1
5,720,339 A * 2/1998 Glass et al. ..... 165/104.26
5,806,803 A * 9/1998 Watts ..... 244/163
6,810,944 B1 * 11/2004 Wiacek et al. ..... 165/41
2004/0040691 A1 * 3/2004 Jacque et al. ..... 165/42

* cited by examiner

*Primary Examiner*—Terrell Mckinnon
(74) *Attorney, Agent, or Firm*—Ingrassia Fisher & Lorenz, P.C.

(57) ABSTRACT

Methods and apparatus are provided for a lightweight heat rejection system suitable for spacecraft applications. The apparatus comprises a manifold configured with an array of heat pipes in thermal contact with a manifold coolant. The heat pipes transfer the coolant heat to associated bumper/radiators external to the manifold. The bumper/radiators are fabricated from a lightweight thermally conductive foam material. The bumper portion protects the heat pipe from space debris and the radiator portion dissipates the heat transferred from the heat pipe through the bumper to the radiator portion. The foam bumper/radiator can be cast over the heat pipe in a relatively simple and economical manufacturing process.

21 Claims, 5 Drawing Sheets

FOAM BUMPER AND RADIATOR FOR A LIGHTWEIGHT HEAT REJECTION SYSTEM

TECHNICAL FIELD

The present invention generally relates to heat rejection systems, and more particularly relates to a foam bumper and radiator configuration for a lightweight heat rejection system.

BACKGROUND

A heat rejection system is typically used to remove excess heat from a power generating system. One type of heat rejection system, generally known as a pumped loop system, involves the use of a coolant medium circulated through a heat transfer duct in order to transfer heat from a power generating source to heat dissipating radiators. Another type of heat rejection system uses heat pipes rather than heat transfer ducts to transfer heat from a coolant medium to heat dissipating radiators.

In certain types of high performance heat dissipation applications, such as spacecraft cooling for example, the weight of a heat rejection system can become a limiting factor in the overall performance capabilities of the spacecraft. Moreover, the heat transfer ducts or heat pipes in a spacecraft heat rejection system can be damaged by contact with MicroMeteoroid and Orbital Debris (MMOD), and are therefore typically protected by the inclusion of some type of shielding. Conventional types of protective shields generally complicate the fabrication process of the heat dissipating components while adding undesired weight to the system. In addition, conventional protective shields tend to reduce the thermal radiation efficiency of the heat dissipating components.

Accordingly, it is desirable to provide a heat rejection system with MMOD protection that is both lightweight and thermally efficient. In addition, it is desirable to provide a fabrication process for the exemplary heat rejection system that is relatively straightforward and economical. Furthermore, other desirable features and characteristics of the present invention will become apparent from the subsequent detailed description and the appended claims, taken in conjunction with the accompanying drawings and the foregoing technical field and background.

BRIEF SUMMARY

According to various exemplary embodiments, devices and methods are provided for reducing the weight and improving the thermal conductivity of a shielded heat rejection system. One exemplary device comprises a manifold configured with a heat transfer passageway for carrying a coolant medium. One or more heat pipes are each configured with a heat input portion that is in thermal contact with the coolant medium within the manifold. The one or more heat pipes are each further configured with a heat output portion that is in thermal contact with an associated heat radiator. The heat radiator is configured in part as a protective bumper enclosing an exposed outer surface of the associated heat pipe, and the heat radiator is further configured with at least one heat-dissipating fin. The heat radiator protective bumper and the heat-dissipating fin(s) are fabricated from a foam material to provide thermal conductivity away from the heat pipe.

One exemplary method of fabricating the heat radiator foam bumper and fin(s) comprises the steps of casting a foam material around the outer surface of the associated heat pipe, shaping the foam material to form a bumper around the outer surface of the heat pipe, and shaping the foam material to form at least one fin integrated into the outer surface of the foam bumper. The foam bumper is configured to provide a protective shield around the heat pipe, and the foam bumper and fin(s) are further configured to provide thermal radiation away from the heat pipe.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Various embodiments of the present invention pertain to the area of heat rejection systems in applications such as spacecraft cooling, where it is generally desirable to minimize system weight and to maximize the thermal conductivity of the cooling apparatus. Moreover, in space applications, it is also desirable to protect the cooling apparatus from damage by MicroMeteoroid and Orbital Debris (MMOD). A foam bumper and radiator fin configuration is proposed that is generally lighter in weight than conventional bumper and radiator assemblies, and that also provides protection from MMOD. In addition, the proposed foam configuration can improve the thermal conductivity of the cooling apparatus.

Figure 1:
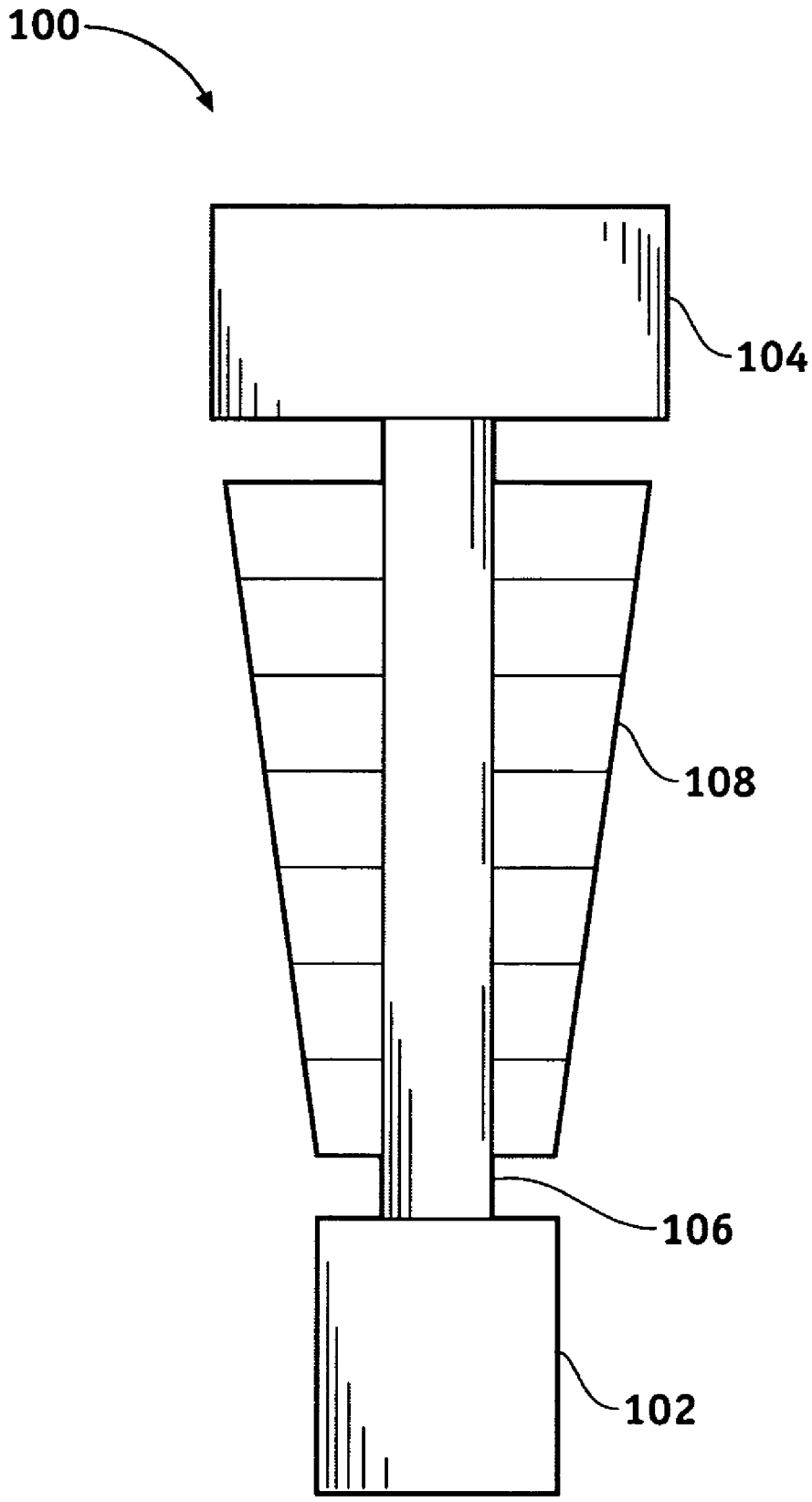
FIG. 1 is an exemplary illustration of a spacecraft with a heat rejection system.

A simplified illustration of one type of space vehicle 100 is shown in FIG. 1. In this example, a power source 102 provides power to a propulsion system 104 via a heat rejection system that includes a manifold 106 and a series of radiator panels 108. Typically, manifold 106 functions as a conduit for a cooling fluid (not shown), such that heat generated from power source 102 is transferred through the cooling fluid in manifold 106 to thermally connected dissipating radiators 108.

Figure 2:
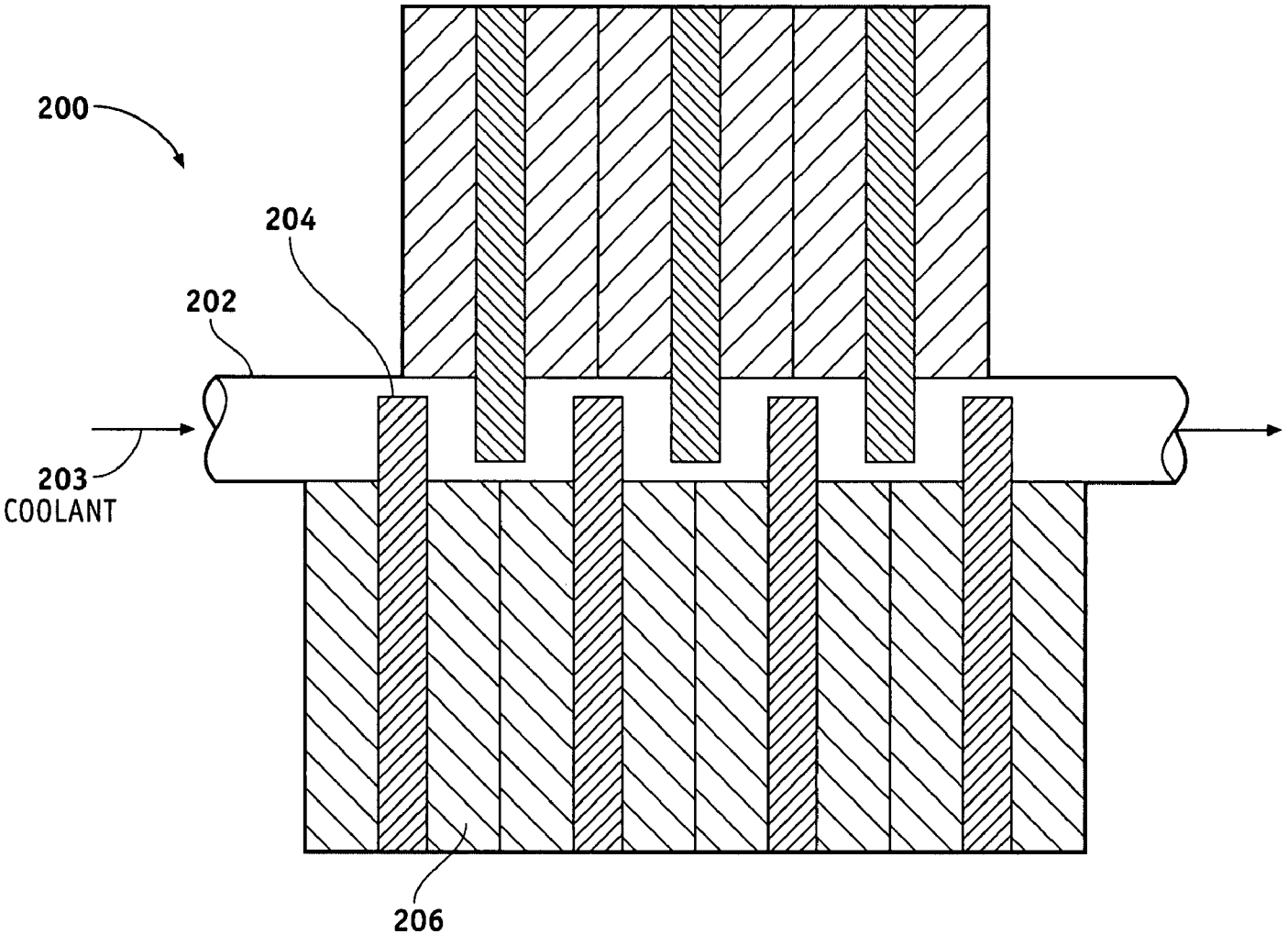
FIG. 2 is an exemplary illustration of a heat pipe and radiator configuration.

FIG. 2 depicts one example of a manifold/radiator heat-dissipating configuration 200 that incorporates heat pipes to transfer heat from a manifold to heat dissipating radiators. A manifold 202 is generally configured to receive a cooling fluid 203 that passes through manifold 202. An array of heat pipes 204 are typically integrated into manifold 202 such that the heat input sections of heat pipes 204 are contacted by cooling fluid 203 as it passes through manifold 202. As will be described more fully below, the heat received by heat pipes 204 from cooling fluid 203 is typically transferred to the heat output sections of heat pipes 204. In this example, each heat output section of heat pipes 204 is thermally connected to an associated radiating fin 206, such that the heat is transferred into radiating fins 206, from where it is typically radiated into space.

Figure 3:
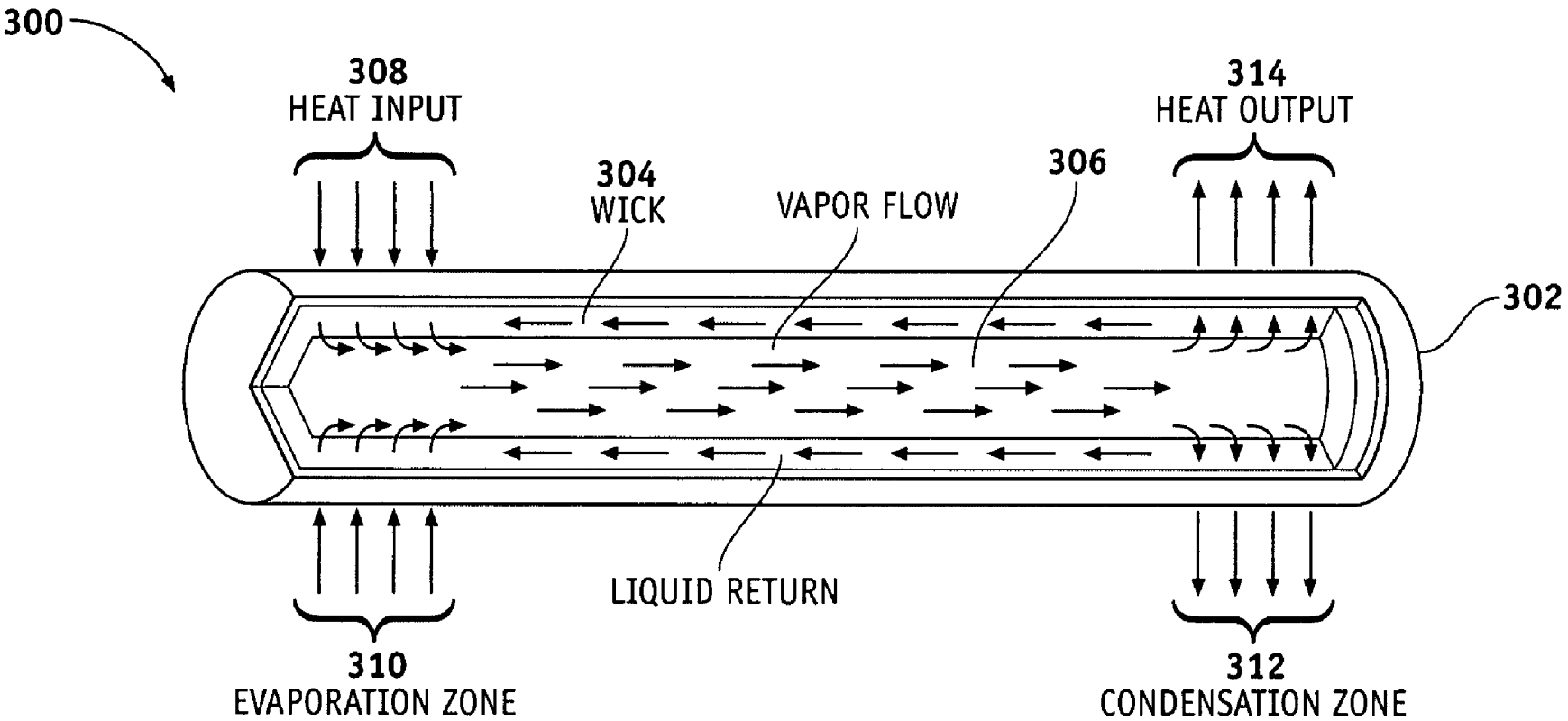
FIG. 3 is an exemplary illustration of heat pipe operation.

The operation of a typical heat pipe 300 is illustrated in FIG. 3. A closed container 302 generally incorporates a wick structure 304 and a small amount of working fluid 306 that is normally saturated at operating conditions. Heat pipe 300 typically employs a boiling-condensing cycle, wherein a heat input 308 around the evaporation zone 310 of heat pipe 300 causes working fluid 306 to boil and to enter a vapor state with a latent heat of vaporization. The vapor generally moves through heat pipe 300 to a colder location (condensation zone 312), where it condenses back into working fluid 306. The condensation process gives up the latent heat of vaporization as heat output 314 around the condensation zone 312 of heat pipe 300. Capillary action of wick structure 304 acts to transport the condensate (working fluid 306) back to evaporation zone 310 of heat pipe 300, and the process continues.

Heat pipes can be designed as highly efficient heat transfer devices since the vapor pressure drop between the evaporation zone and condensation zone is typically very small. As such, the temperature losses between a heat source and the vapor, and between the vapor and a heat sink can be very small. Moreover, heat pipes can be used to transfer relatively large amounts of heat within relatively small, lightweight structures. Therefore, the combined features of efficient heat transfer and lightweight structure make heat pipes generally advantageous for use in heat rejection systems for spacecraft types of applications. It will be appreciated that an alternate heat transfer configuration can incorporate heat transfer ducts (pumped loop) rather than heat pipes in a heat rejection system. As such, the following discussion can pertain to a heat pipe or a heat transfer duct configuration, but will generally be referenced to heat pipes for clarity.

Figure 4:
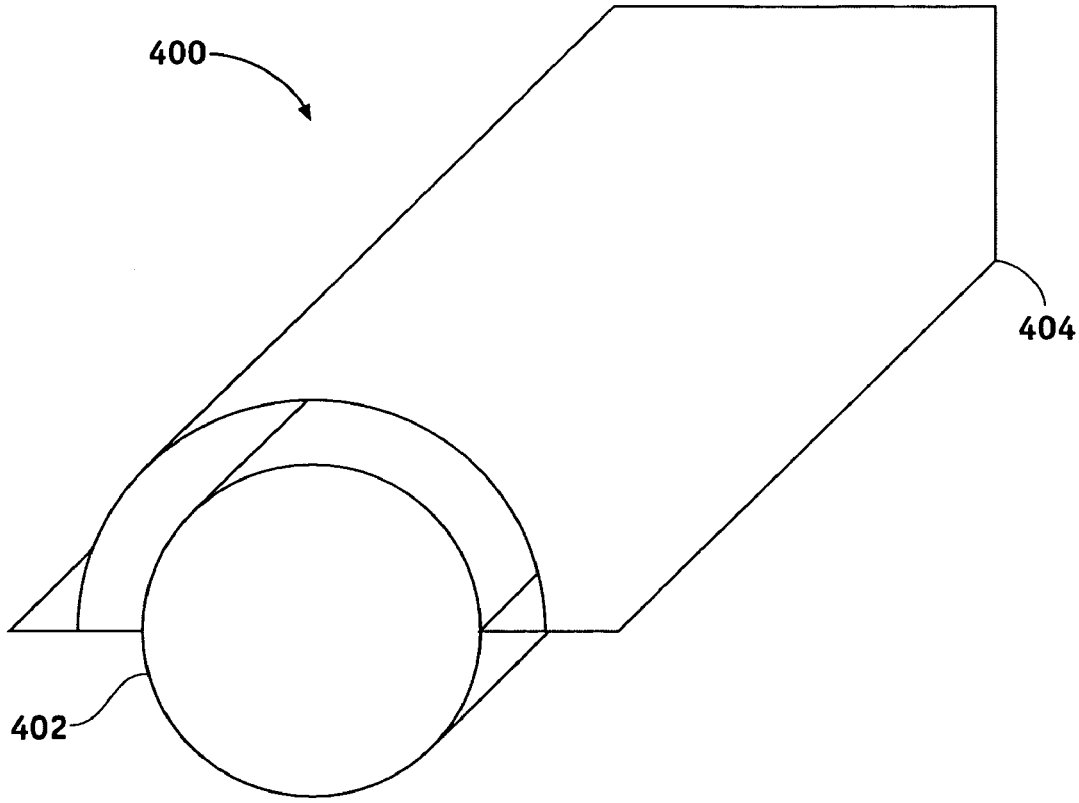
FIG. 4 is an exemplary illustration of a heat pipe with standoff bumper.

One potential disadvantage of a typical lightweight heat pipe structure is that it is relatively vulnerable to physical damage. In a spacecraft application, for example, there is the possibility of a collision between the heat pipes built into radiator panels and the previously mentioned MMOD. To protect a lightweight heat pipe from MMOD damage, a standoff bumper type of shielding has typically been mounted around the exposed portion of the heat pipe. One example of a typical standoff bumper configuration 400 is illustrated in the simplified diagram of FIG. 4, where a standoff bumper 404 is used to protect the otherwise exposed exterior surface of a heat pipe 402. Typically, heat pipe 402 is fitted into a close-fitting sleeve (not shown) that structurally reinforces heat pipe 402, but this type of sleeve is generally not adequate to protect heat pipe 402 from the impact of MMOD. Therefore, standoff bumper 404 is typically attached to the sleeve around heat pipe 402 to provide collision protection for heat pipe 402. However, a conventional standoff bumper configuration such as 404 will typically add significant weight to the heat rejection system, which is generally disadvantageous for a spacecraft application. Moreover, a typical standoff bumper 404 can reduce the thermal radiation conductivity between heat pipe 402 and an external radiator, which is also generally disadvantageous for a spacecraft or similar application.

Figure 5:
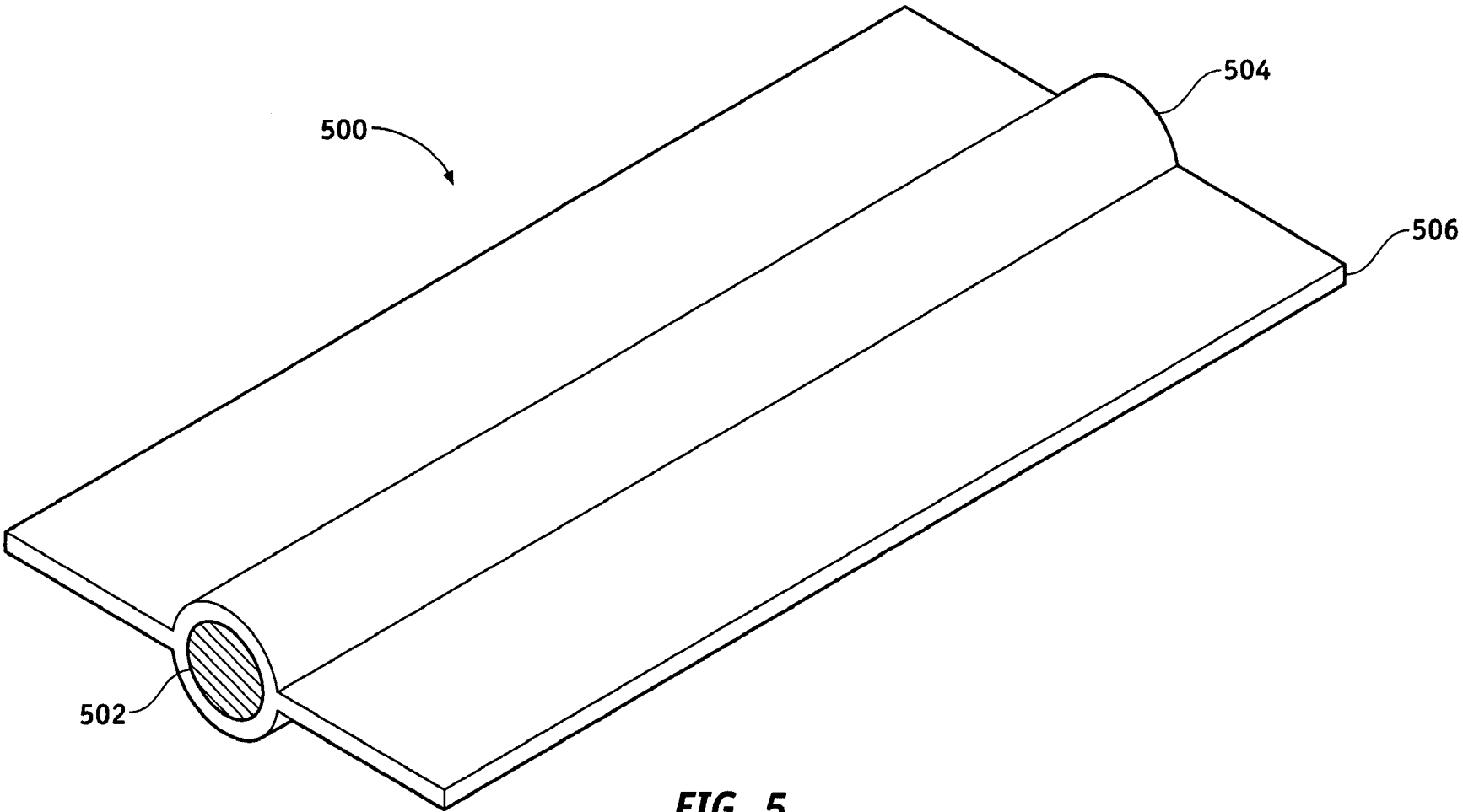
FIG. 5 is an illustration of an exemplary embodiment of a foam bumper and radiator configuration.

In accordance with an exemplary embodiment of an improved heat pipe/radiator configuration 500 as illustrated in FIG. 5, a heat pipe 502 is covered with a foam material 504. In this embodiment, foam material 504 is configured to function as a protective bumper for the exposed surfaces of heat pipe 502. In addition, foam material 504 is typically integrated with foam material radiator fins 506 to form a foam material bumper/radiator (504, 506) for heat pipe 502. Heat pipe 502 is typically enclosed within a structural sleeve (not shown for clarity) between heat pipe 502 and foam material 504.

Various types of foam material may be used for bumper/radiator 504, 506, such as metal, carbon-carbon, ceramic, graphite, etc., and/or a combination of these materials. Foam materials such as these are generally available from commercial sources in a wide range of shapes and porosities. One commercial source is ERG Materials and Aerospace Corporation in Oakland, Calif. A distinguishing feature of foam material is the porosity of its open-celled structure, as in a honeycomb pattern, for example. The cavity-like pores of the foam surface typically increase the effective thermal emissivity of the foam material for a more efficient thermal radiation surface. As such, a low-density foam material can improve the thermal conductivity of bumper/radiator 504, 506 over that of a conventional material (e.g., aluminum) standoff bumper 404 in FIG. 4. That is, foam bumper 504 can conduct heat directly and relatively more efficiently from heat pipe 502 to radiator fins 506. This increased heat transfer efficiency may allow a reduction in the length of fins 506, which would generally be desirable for a spacecraft application. Also, the thickness of fins 506 may be increased against the surface of bumper 504, thereby enabling a further improvement in heat dissipation effectiveness.

Another advantageous feature of foam material is its lighter weight in comparison to conventional materials. As such, a foam bumper/radiator configuration (504, 506 in FIG. 5) would typically provide a significant reduction in weight as compared to a conventional solid material standoff bumper and radiator fin configuration. Therefore, a lighter weight foam bumper and radiator can be advantageously configured for a spacecraft or other type of application where weight reduction is a desirable objective.

In addition to providing improved thermal conductivity and lighter weight, a foam material bumper/radiator can be simpler and more economical to manufacture than a conventional material standoff bumper/radiator. For a conventional material such as a carbon-carbon weave, for example, a relatively complex manufacturing process is typically employed to create the bumper, radiator fins and heat pipe sleeve assembly. In contrast, an integrated foam bumper/radiator can be produced in a more straightforward manner by casting the foam over the heat pipe sleeve and then shaping the bumper and radiator fins to a desired geometry.

Accordingly, the shortcomings of the prior art have been overcome by providing improved bumper and radiator embodiments for heat pipes or heat transfer ducts in a heat rejection system. The improved bumper and radiator embodiments are typically fabricated in an integrated configuration from a porous foam material that can be cast directly over a heat pipe or heat transfer duct. The resulting foam material bumper and radiator generally provide better thermal conductivity than a conventional material bumper and radiator assembly, and also generally provide a significant reduction in weight. A further benefit of the foam configuration is the relative ease of manufacture in comparison to conventional material assemblies.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A heat rejection system, comprising:

a manifold configured with a passageway for carrying a coolant medium;

at least one substantially cylindrical heat pipe configured with a heat input portion in thermal contact with the coolant medium within the manifold, the at least one substantially cylindrical heat pipe further configured with a heat output portion, and the at least one substantially cylindrical heat pipe having a length; and a heat radiator in thermal contact with the heat output portion of the at least one substantially cylindrical heat pipe, the heat radiator comprising:

a protective bumper enclosing an exposed outer surface of the at least one substantially cylindrical heat pipe, wherein the protective bumper has an outer surface and a substantially annular cross section, and at least one heat dissipating fin integral with the protective bumper, wherein the protective bumper and at least one heat dissipating fin are fabricated from a foam material to provide thermal conductivity away from the at least one substantially cylindrical heat pipe, wherein the at least one fin extends outward from the outer surface of the protective bumper.

2. The heat rejection system of claim 1 wherein the foam material is a type of thermally conducting porous structure.

3. The heat rejection system of claim 2 wherein the foam material comprises metal.

4. The heat rejection system of claim 2 wherein the foam material comprises carbon-carbon.

5. The heat rejection system of claim 2 wherein the foam material comprises graphite.

6. The heat rejection system of claim 2 wherein the foam material comprises ceramic.

7. The heat rejection system of claim 2 wherein the foam material comprises a combination of materials.

8. The heat rejection system of claim 1 wherein the at least one substantially cylindrical heat pipe comprises at least one substantially cylindrical heat transfer duct in a pumped loop system.

9. The heat rejection system of claim 1, wherein the length of the heat pipe is substantially perpendicular to a travel direction of the coolant medium.

10. The heat rejection system of claim 1, wherein the heat pipe further comprises:

a wick structure configured to transport the coolant medium from the heat output portion to the heat input portion.

11. The heat rejection system of claim 1, wherein the coolant medium travels in a direction that is substantially perpendicular to the length of the heat pipe.

12. The beat rejection system of claim 9, wherein the length of the at least one heat pipe is substantially perpendicular to the manifold.

13. A bumper/radiator heat dissipation and protection apparatus for a heat transfer device, comprising:

a thermally conductive foam material configured with;

a first portion that encloses the heat transfer device, wherein the first portion has an outer surface and a substantially annular cross section, and with a second portion integral with the first portion, wherein the second portion extends outward from the outer surface of the first portion, wherein the first portion forms a protective shield around the heat transfer device and wherein the second portion fornis a beat radiator to dissipate heat that is conducted from the heat transfer device though the protective shield to the heat radiator.

14. The bumper/radiator of claim 13 wherein the heat transfer device is a heat pipe.

15. The bumper/radiator of claim 13 wherein the heat transfer device is a duct in a pumped loop system.

16. The heat rejection system of claim 13, wherein the heat transfer device comprises a smaller dimension and a longer dimension that extends in a first direction, and wherein the heat transfer device is configured such tat temperature increases along a second direction that is substantially perpendicular to the first direction.

17. A method of fabricating a bumper/radiator for a heat transfer device, comprising the steps of:

casting a foam material around the outer surface of the heat transfer device;

shaping the foam material to form a bumper around the outer surface of the heat transfer device, wherein the bumper has an outer surface and a substantially annular cross section; and further shaping the foam material to form at least one fin integrated into the outer surface of the bumper, wherein the bumper is configured to provide a protective shield around the heat transfer device, and wherein the bumper and the at least one fin are integral with each other and further configured to provide thermal radiation away from the heat transfer device.

18. The method of claim 11 wherein the foam material is a type of thermally conducting porous structure.

19. The method of claim 18 wherein the heat transfer device is a heat pipe.

20. The method of claim 18 wherein the heat transfer device is a duct in a pumped loop system.

21. The heat rejection system of claim 17, wherein the heat transfer device comprises a smaller dimension and a longer dimension that extends in a first direction, and wherein the heat transfer device is configured such that temperature increases along a second direction that is substantially perpendicular to the first direction.

* * * * *